US006302387B1

(12) United States Patent
Schmalz et al.

(10) Patent No.: US 6,302,387 B1
(45) **Date of Patent: *Oct. 16, 2001**

(54) VACUUM TIGHTENING SYSTEM

(75) Inventors: Kurt Schmalz; Wolfgang Schmalz, both of Dornstetten; Ralf Stockburger, Glatten, all of (DE)

(73) Assignee: J. Schmalz GmbH., Glatten (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/529,918

(22) PCT Filed: Aug. 10, 1998

(86) PCT No.: PCT/EP98/05063

§ 371 Date: Jun. 21, 2000

§ 102(e) Date: Jun. 21, 2000

(87) PCT Pub. No.: WO99/20437

PCT Pub. Date: Apr. 29, 1999

(30) Foreign Application Priority Data

Oct. 22, 1997 (DE) ..... 197 46 497
Mar. 31, 1998 (DE) ..... 198 14 262

(51) Int. Cl.[7] ..... B25B 11/00
(52) U.S. Cl. ..... 269/21; 269/20
(58) Field of Search ..... 269/21, 20, 329; 279/3; 294/64; 451/388

(56) References Cited

U.S. PATENT DOCUMENTS 3,484,093 12/1969 Mermelstein ..... 269/21
6,095,506 * 8/2000 Schmalz et al. ..... 269/21

FOREIGN PATENT DOCUMENTS

3434329 C1 4/1936 (DE) ..... B25B/11/00
29 42 876 A1 5/1980 (DE) ..... B25B/11/00
3429444 C2 2/1987 (DE) ..... F15B/13/01
3531010 C1 2/1987 (DE) ..... B65G/47/91
36 17 153 C2 6/1988 (DE) ..... A61L/2/26
88 15 392 U1 5/1989 (DE) ..... B56G/47/91
42 21 222 A1 1/1994 (DE) ..... B25B/11/00
4404413 C1 1/1995 (DE) ..... B23C/3/08
295 18 188 U1 2/1996 (DE) ..... F15B/13/01
296 13 129 U1 7/1997 (DE) ..... F16B/31/02
297 04 991 U1 8/1997 (DE) ..... B25B/11/00
196 08 798 A1 9/1997 (DE) ..... F16K/31/44
196 13 094 A1 10/1997 (DE) ..... B25B/11/00
1168168 12/1958 (FR) ..... B25B/11/00

* cited by examiner

*Primary Examiner*—Derris H. Banks
*Assistant Examiner*—Daniel Shanley

(57) ABSTRACT

The invention relates to a vacuum tightening system comprising a supporting base and a modular suction device for tightening a work piece. According to the invention, the modular suction device and the work piece can be tightened by means of a vacuum circuit in which the vacuum pressure is increased for tightening the work piece.

17 Claims, 9 Drawing Sheets

VACUUM TIGHTENING SYSTEM

This application is the national phase under 35 §371 of PCT International Application No. PCT/EP98/05063 which has an International filing date of Aug. 10, 1998, which designated the United States of America.

DESCRIPTION

The present invention relates to a vacuum hold-down system comprising a supporting base and a modular suction device, mountable on a support surface of the supporting base, upon which a work piece to be clamped to can be placed, wherein the support surface of the supporting base is provided with shutoff valves through which air suction can be applied for holding down the modular suction device and/or the work piece, and wherein the modular suction device has, on its underside contacting the support surface, a seal surrounding at least one shutoff valve, thereby forming a closed space which can be evacuated through the shutoff valve.

For woodworking machines in particular, spreader bars are known upon which modular suction devices are mounted (DE 295 18 188 U1) and which serve to hold-down work pieces for working on them, for example wood slats and the like. After the modular suction devices are mounted on the spreader bars, the modular suction devices are securely suctioned to the spreader bars in fixed positions. This is accomplished by opening shutoff valves in a first vacuum circuit, through which a first closed space on the underside of each modular suction device is connected to the first vacuum circuit. After the work piece is placed on the modular suction device, vacuum is applied at a second vacuum circuit, such that the modular suction device sucks down the work piece. This is achieved by providing on a topside of the modular suction device a hold-down space which is connected to the underside of the modular suction device by a connecting line which passes through the modular suction device, and which leads from a second space provided there for holding down the modular suction device to the spreader bar. This connection line is connected to the second vacuum circuit. In order to hold down the work piece, the modular suction device is first positioned and the work piece is then held down. These hold-down systems have a significant advantage in that the modular suction devices can be centrally held down, and the work pieces can be centrally sucked down through the modular suction devices. Thus, a hose connection to each individual modular suction device, which often is problematic, is not required. The work piece can thus be detached without detaching the modular suction device.

However, the spreader bars have proven to be relatively expensive since they must be equipped with two vacuum circuits. In addition, the spreader bars must be provided with two shutoff valves at each location not covered by modular suction devices, so that the two vacuum circuits can be closed there. Furthermore, the modular suction devices can only be displaced on the spreader bars linearly, that is, along one direction, corresponding to a longitudinal extension of the spreader bar. The spreader bars must be displaced relative one another in a direction transverse thereto. If different work pieces are processed in succession, under certain conditions this can lead to considerable expense for adjustments. In addition, the modular suction devices generally cannot be rotated.

Also known are work-hold-down tables upon which modular suction devices can be optionally placed. These work-hold-down tables have the advantage that positions of the individual modular suction devices can be precisely adjusted to a shape of a work piece. Furthermore, repositioning of the modular suction devices is relatively simple.

A disadvantage of such work-hold-down tables, however, is that the individual modular suction devices must be connected to vacuum sources by hose connections. These hose connections are problematic when working on the work pieces because for one thing they lie on the work-hold-down table beside the modular suction devices and they become covered up by waste materials. Such hose lines can also be easily damaged.

It is therefore an object of this invention to eliminate the previously described disadvantages and/or to provide a vacuum hold-down system of relatively simple construction which offers flexibility of use.

This object is achieved by the invention, in that a space provided on an underside of a modular suction device is coupled to a pressure control valve which is, in turn, coupled to a topside of the modular suction device by opening into a hold-down space that is circumscribed by a second seal.

In the vacuum hold-down system of the invention, the space for holding down the modular suction device on a hold-down base, for example a spreader bar, a work-hold-down table, or the like, is connected by the pressure control valve to the hold-down space provided on the topside, by which the work piece is held down. The work piece is thus held down over the space which serves to hold down the modular suction device. This inventive solution has the significant advantage that only a single vacuum circuit is required to hold down both the modular suction device and the work piece. A structure of the supporting base is therefore considerably simpler than for systems having two vacuum circuits. Despite the use of only one vacuum circuit, the work piece and the modular suction device can be held down independently of one another. The work piece can thus be detached while the modular suction device remains held down. No hose connections are required. The modular suction device can be mounted on beams as well as on tables.

Since only a single vacuum circuit is required, only one shutoff valve is needed for a suction holes in the supporting base, so that the number of shutoff valves required is halfed compared to known embodiments. In addition, the modular suction device in the vacuum hold-down system of this invention need not be placed on the supporting base in a particular configuration. In the current state-of-the-art, a modular suction device must always be attached so that a first suction hole communicates with a space for sucking down the modular suction device and a second suction hole communicates with a connection line to the hold-down space. If the modular suction device were mounted in a rotated orientation—if this were even possible—malfunctions could result. Since the modular suction device can only be mounted in a specified position or orientation, options for use of known hold-down systems are therefore limited. In the hold-down system according to the invention, the modular suction device as well as the work piece are held down with a single suction hole in the supporting base. Thus, the modular suction device can also assume any desired position and configuration (rotational position) on the supporting base, provided that the space for holding down the modular suction device communicates with a suction hole in the supporting base.

In one embodiment according to the invention, the pressure control valve on the one hand opens when a given negative pressure is reached, and on the other hand couples the hold-down space on the topside of the modular suction device with the space on its underside. The single-circuit system, according to the invention, is driven by two different pressures. The one negative pressure serves to hold down the modular suction device and the second negative pressure, which is larger than the first negative pressure, serves to hold down the work piece (and thus, holds down the modular suction device as well), with the pressure control valve being controlled by the second negative pressure such that it opens and establishes the connection between the hold-down space provided at the topside and the space for holding down the modular suction device. In order to hold down the work piece, the system vacuum need only be increased. The pressure control valve according to the invention can be thusly vacuum-activated.

However, other embodiments are also conceivable in which the pressure control valve is formed from a push valve, so that upon mounting of the work piece on the modular suction device, the valve is opened by the work piece to evacuate the hold-down space, thus effecting hold-down of the work piece.

In order to detach the work piece, only the pressure in the upper hold-down space need be reduced. To this end the pressure is lowered, and the modular suction device remains securely held.

In a variation according to the invention, the pressure control valve is spring-loaded in the closed direction. The negative pressure required to open the pressure control valve can be adjusted to a desired value by means of the spring. That is, by changing the spring force and, thus, a pressure value at which the pressure control valve opens, the hold-down pressure at which the work piece is held down can be adjusted. In this manner, even somewhat sensitive work pieces can be held down with relatively low pressure. Furthermore, such pressure control valves that are closed by springs can be fabricated in an uncomplicated manner and economically produced.

The pressure control valve, in its closed position, advantageously projects beyond a supporting surface on the topside of the modular suction device. This portion of the pressure control valve that projects beyond the topside of the modular suction device functions as an ejector, and, after hold-down, lifts a work piece from the surface of the modular suction device. Any slight negative pressure still present in the hold-down space is thus relieved. In addition, the portion of the pressure control valve projecting beyond the topside of the modular suction device can be provided at its top end with a slide lining, for example a Teflon coating or the like, so that the work piece can be shoved fairly easily into a desired position along this slide lining.

A seal of the modular suction device which surrounds the shutoff valve is advantageously wider than a cross section of a flow opening of the shutoff valve. This thereby avoids leakage caused by only a partial covering of a shutoff valve by a modular suction device, which can lead to malfunctions; that is, defective suction of the modular suction device. If the modular suction device is mounted on the supporting base such that the seal is placed on a shutoff valve, the valve is then completely closed. If this shutoff valve is nevertheless activated, that is to say, opened, flow is prevented by the seal. If the shutoff valve is located within the space and is partially covered by the seal, the space for holding down the modular suction device is still reliably provided with vacuum. However, if the shutoff valve partially extends to the outside and is partially covered by the seal, the shutoff valve is not activated. Due to the wide seal, however, the space for holding down the modular suction device is not coupled to the exterior, that is, to atmosphere, via the shutoff valve.

A distance between two shutoff valves or a distance between flow cross sections of the valves in a support plane of the supporting base is advantageously less than or equal to a distance between two oppositely situated seals surrounding the shutoff valves, or is at least the distance between two oppositely situated seal edges of the seals of the modular suction device. This assures that when the modular suction device is mounted on the supporting base, the space on the underside circumscribed by the seal is always seated on a shutoff valve, such that the space can be provided with vacuum.

In a variation, the pressure control valve has a piston having an axial, upwardly-protruding extension, with the extension being surrounded by a seal, but having a bypass bypassing the seal when the piston assumes a intermediate position between the closed position and the open position of the pressure control valve. The bypass allows ventilation of the hold-down space when the piston assumes its intermediate position. If the piston is situated in its open position, the hold-down space is then completely separated from atmosphere. The hold-down space can thus be supplied with vacuum so that the work piece can be held down. If the work piece is detached from the modular suction device, the vacuum is reduced until the pressure control valve closes. As a rule, the piston thereby assumes an intermediate position first, where a certain negative pressure still prevails in the hold-down space. This vacuum is reduced by the hold-down space over the bypass being connected to atmosphere. In this manner, after the pressure control valve closes, the hold-down space of each modular suction device is ventilated so the work piece can be lifted up easily.

According to a preferred embodiment, the modular suction device is of modular construction and has interchangeable upper parts for different work pieces or work piece sizes. This has the significant advantage that for specific work pieces, for example even very narrow work pieces, work pieces with surfaces difficult to hold down, etc., a specialized modular suction device need not be provided in every instance, but rather, only a modular suction device with a specialized extension need be provided.

Further advantages, features, and details of the invention are set forth in the dependent claims as well as the following description, in which especially preferred embodiments are described in detail, with reference to the drawings. The features illustrated in the drawings and discussed in the description as well as limitations mentioned in the claims can respectively either be used alone or in any combination according to the invention. The drawings illustrate the following:

Figure 1:
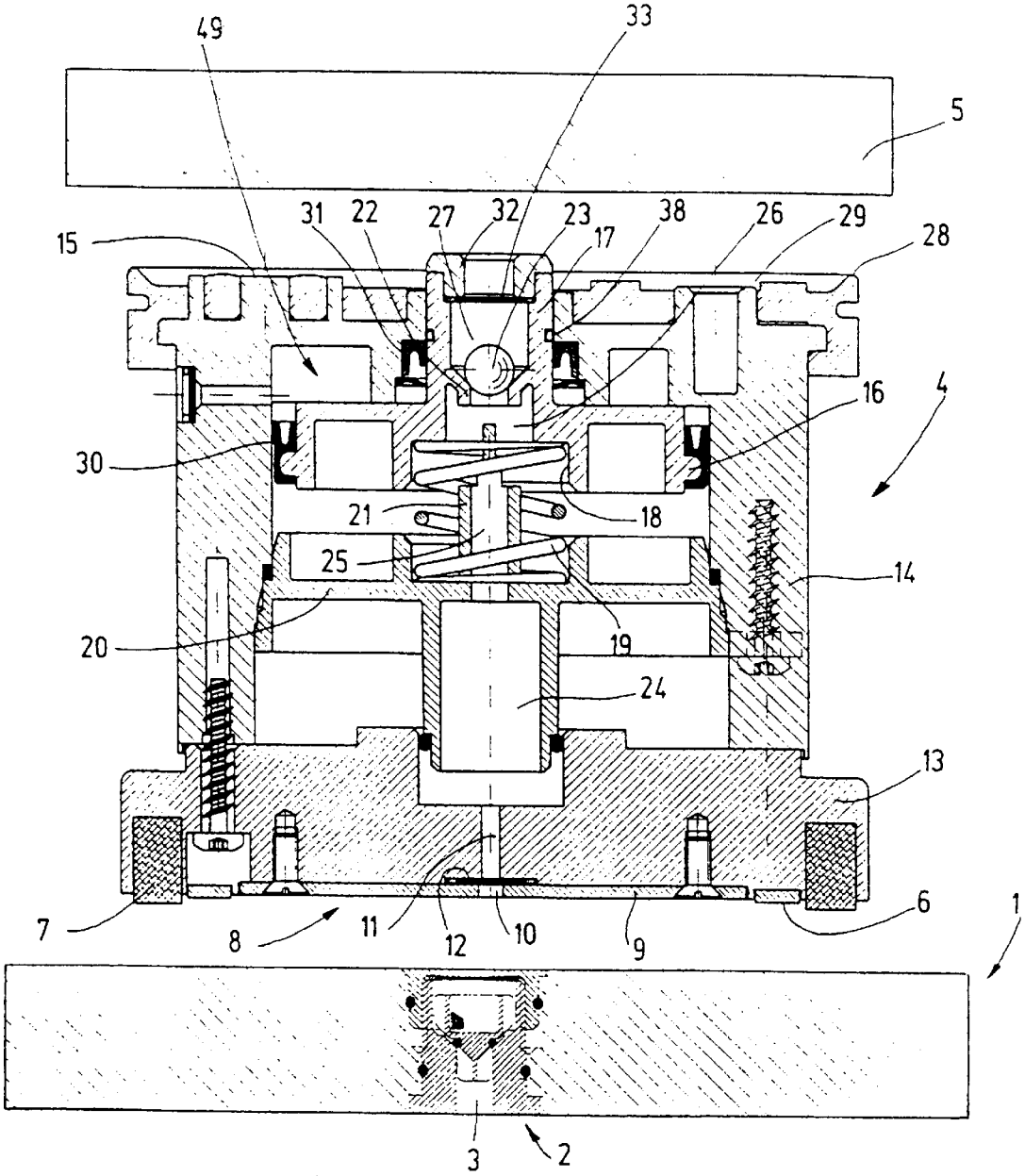
FIG. 1 is a longitudinal section taken through a first embodiment of a modular suction device and a supporting base according to the invention.

FIG. 1 shows an upper portion of a supporting base designated generally as 1, in which a shutoff valve 2 is arranged. A flow channel 3 is opened or closed by means of the shutoff valve 2, which is in its closed position in FIG. 1. A modular suction device, generally designated as 4, is located above the shutoff valve 2, over which a work piece 5, for example a hold-down plate or the like, can be attached by suction and held securely. The modular suction device 4 has on its underside 6 a surrounding seal 7 which encloses a suction space 8. Within the suction space 8, on the underside 6, a ferromagnetic-material plate 9, for example a steel plate, is fastened by screws. This plate 9 has a central opening 10 which is aligned with a flow channel 11. A sieve 12 is located directly behind the opening 10. The seal 7 and the plate 9 are located on a lower part 13 of the modular suction device 4. An upper part 14 is screwed onto the lower part 13, upon whose topside 15 the work piece 5 is supported.

The upper part 14 has a sectionally cylindrical construction, in which a pressure control valve 49 is arranged, in which a piston 16, having an axial extension 17 which projects over the topside 15 of the modular suction device 4, is axially guided. The piston 16 is provided on its underside with a spring receptacle 18 in which a coiled pressure spring 19, which is supported by a brace 20, engages and presses the piston 16 into its closed position, as shown in FIG. 1. Coaxial to the coiled pressure spring 19, the brace 20 is provided with a finger 21 which projects beyond the coiled pressure spring 19. Coaxial to the finger 21, a valve throat 22 is in the extension 17, in which a valve ball 23 is mounted. The flow channel 11 communicates with the topside 15 via an axial hole 24 in the brace 20 as well as an axial hole 25 in the finger 21 which opens essentially radially at its top end, an axial hole 26 in the piston 16, the valve throat 22, and an axial hole 27 in the extension 17. This topside 15 has a surrounding seal 28, so that a hold-down space 29 is enclosed within the seal 28. The piston 16 is guided, fluid-tight, in the upper part 14 of the modular suction device 4 by a radial seal 30. The same is true for the extension 17, which is guided by a radial seal 31.

A free end of the extension 17 is provided with a cap 32 which includes a slide lining, for example Teflon or the like, upon which the work piece 5 can slide easily. Another screen 33 is located below the cap 32.

Figure 2:
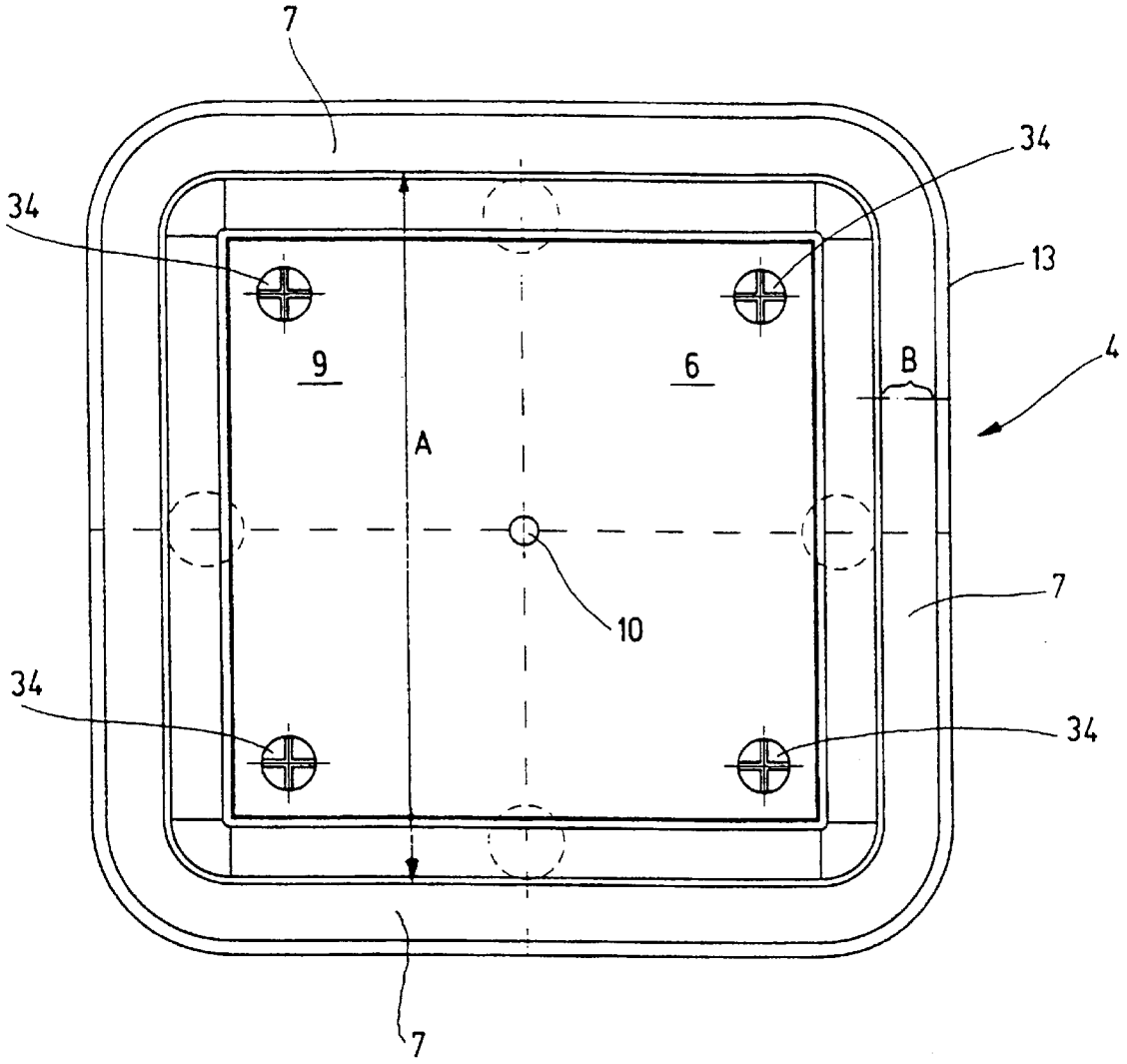
FIG. 2 is a view of the underside of the modular suction device of FIG. 1.

FIG. 2 shows the underside 6 of the lower part 13 of the modular suction device 4, and in particular the plate 9 which is fastened to the lower part 13 by four screws 34. The central opening 10 is located in the middle. Surrounding the plate 9 is the seal 7, which has a certain width B.

Figure 3:
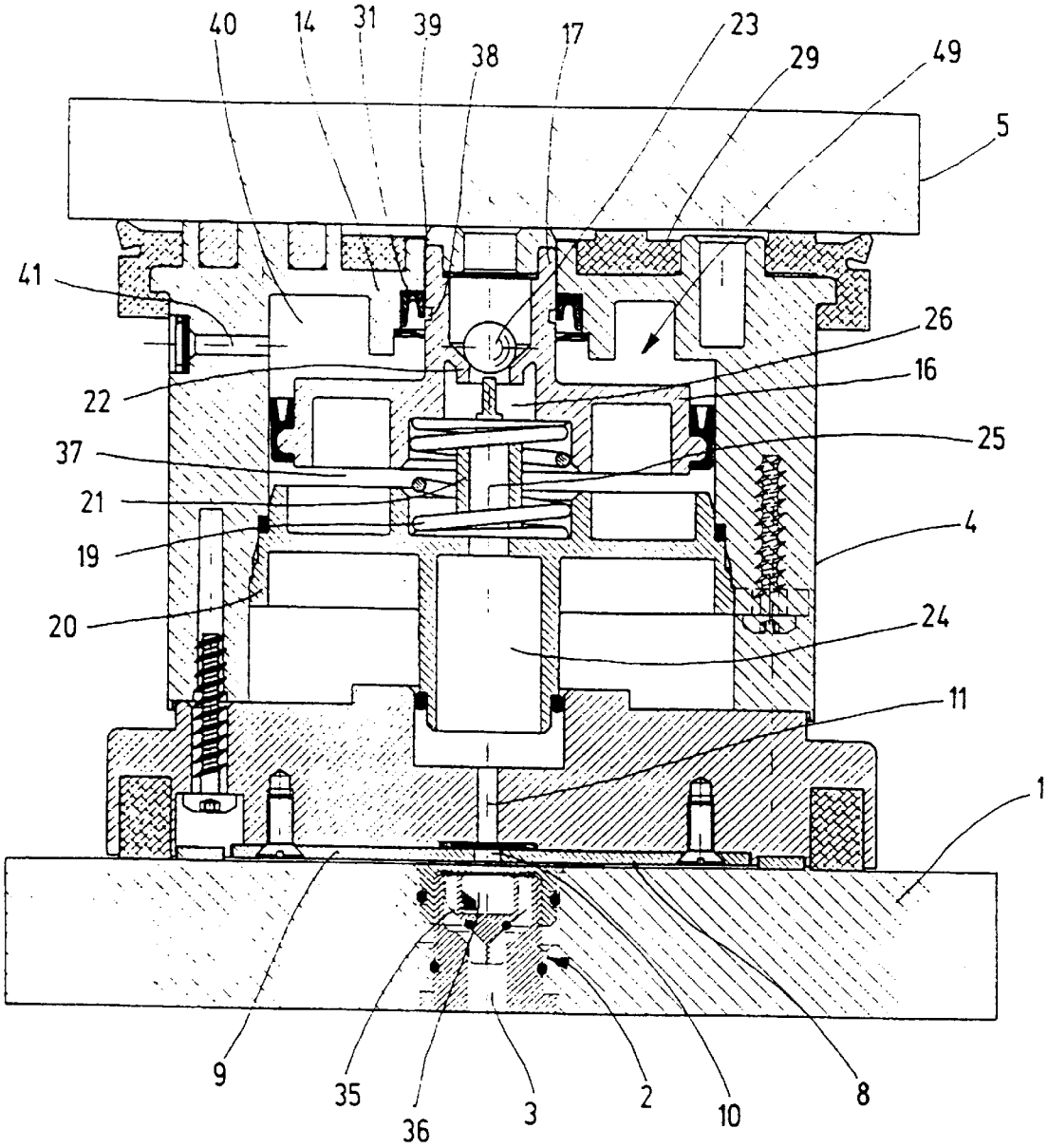
FIG. 3 is a longitudinal section taken through the modular suction device mounted on the supporting base of FIG. 1, with a work piece laid thereon but not yet held down.

FIG. 3 shows the modular suction device 4 on the supporting base 1, with the work piece 5 lying on the modular suction device 4. In this regard, the valve head 35 of the shutoff valve 2, which is provided in the flow channel 3, is moved in the direction of the plate 9 by a magnet 36 in the valve head 35. This shutoff valve 2 assumes its open position. If a vacuum is now applied in the flow channel 3, air is sucked from the suction space 8, the opening 10, the flow channel 11, the axial hole 24, the axial hole 25, the axial hole 26, and the intermediate space 37 beneath the piston 16. In this manner, suction is applied to the modular suction device 4 which is thereby held securely to the supporting base 1.

In addition, the piston 16 is sucked and displaced downwardly to an intermediate position. The piston 16 reaches the intermediate position, shown in FIG. 3, when negative-pressure forces on the underside of the piston 16 are in equilibrium with a spring force of the coiled pressure spring 19, which is directed upwardly. It is also evident from FIG. 3 that the piston 16 is drawn quite close to the brace 20, so that a free end of the finger 21 is closer to the valve ball 23 than in the rest position of the piston 16. However, the free end of the finger 21 does not yet contact the valve ball 23, so that the valve ball still sealingly rests in the valve throat 22. As previously mentioned, the negative pressure and the spring force of the coiled pressure spring 19 are matched to one another so that the piston 16 assumes this intermediate position. In addition, the negative pressure is so high that the modular suction device 4 is securely held down on the supporting base 1.

Figure 4:
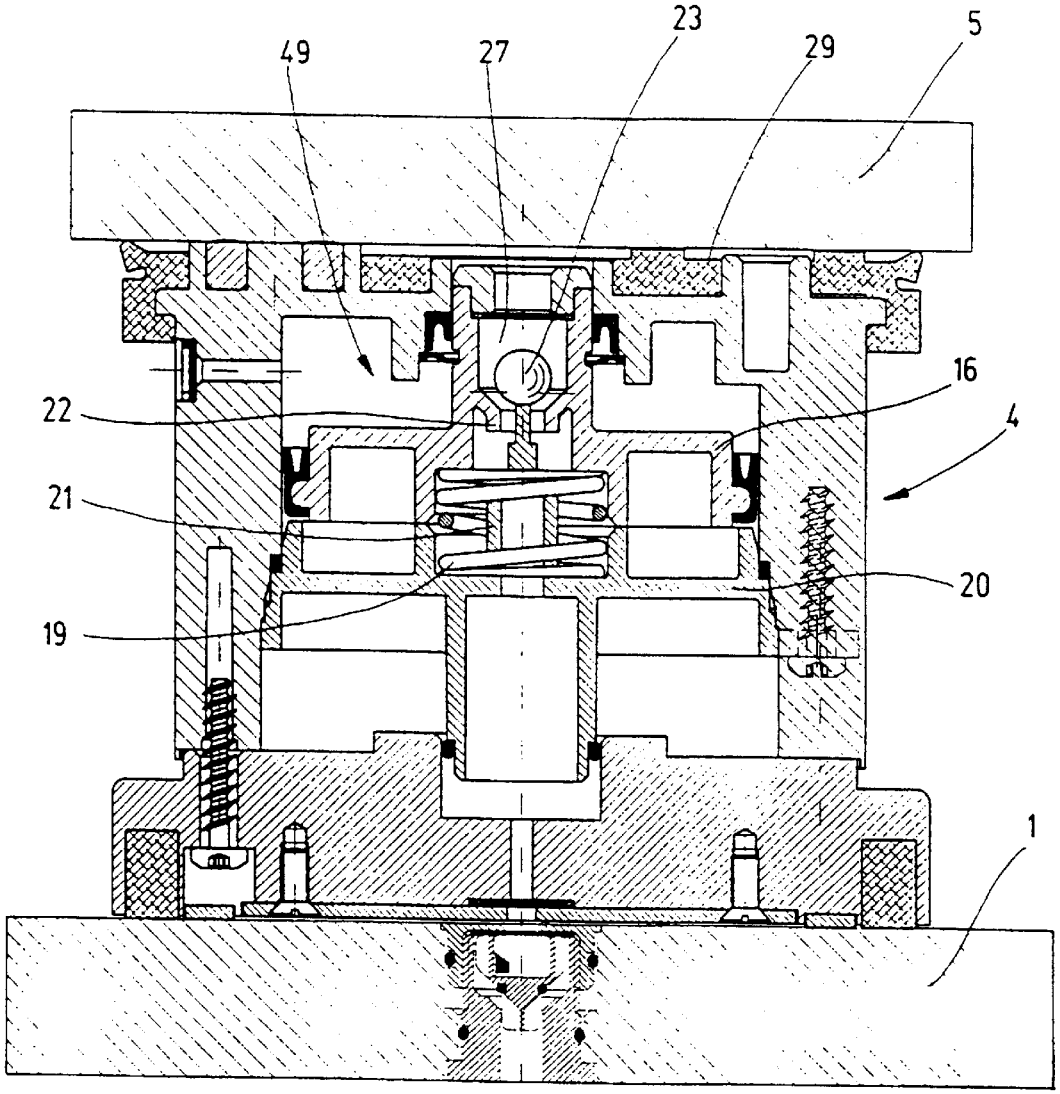
FIG. 4 is a view as in FIG. 3, but with the work piece being held down.

If the negative pressure is increased, the piston 16 is drawn farther down and eventually completely to the brace 20, as shown in FIG. 4. The free end of the finger 21 thus extends into the valve throat 22 from below, and lifts the valve ball 23 from its valve seat. At this point communication to the axial hole 27 and to the hold-down space 29 is created, such that air is sucked from these areas and the work piece 5 is thus clamped onto the modular suction device 4. The increase in negative pressure must therefore be great enough that the piston 16 is drawn far enough toward the brace 20 so that the force of the coiled pressure spring 19 is overcome and the valve ball 23 is lifted.

If the work piece 5 is to be detached from the modular suction device 4, the negative pressure is sufficiently reduced until the piston 16 again assumes its intermediate position, as shown in FIG. 3. But, since negative pressure would still be maintained in the hold-down space 29 at this point, the hold-down space must be ventilated in order to lift the work piece 5 from the modular suction device 4. This is achieved by means of a bypass 38 which bypasses the sealing lip of the seal 31 (FIG. 3), which bypass communicates on the one hand with a slit 39 extending between the extension 17 and the upper part 14, and on the other hand with an annular space 40 having a ventilation channel 41 leading to the outside. The bypass 38 is not constructed as a ring groove, but rather is formed from indentations or the like.

Figure 5:
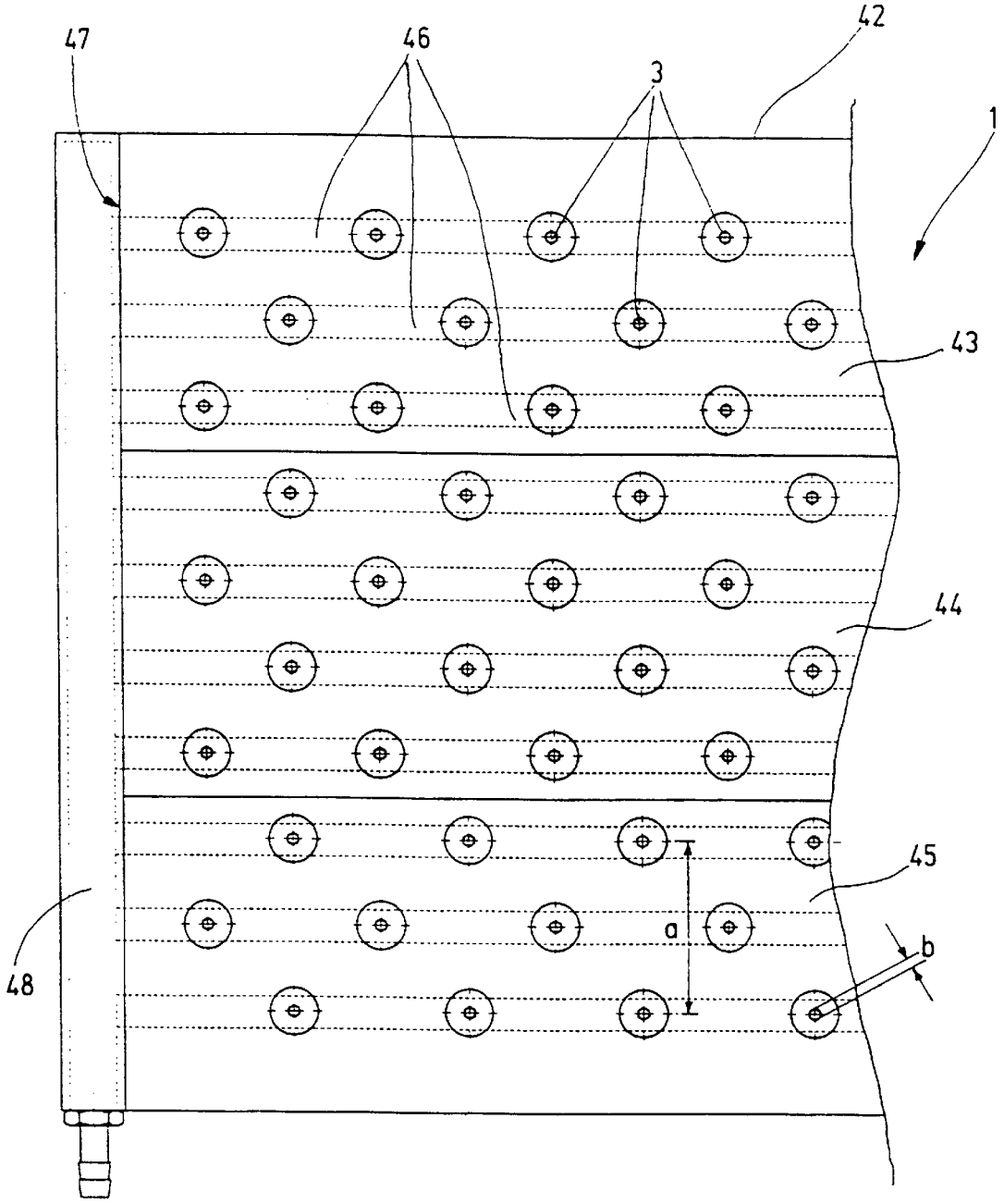
FIG. 5 is a top view of a supporting base formed as a work-hold-down table.

FIG. 5 shows a work-hold-down table 42 as an embodiment of the supporting base 1. In this embodiment example, the work-hold-down table 42 is constructed of three modules 43 through 45, which can be placed together along their longitudinal sides. The modules are provided with flow channels 46 which extend in the longitudinal direction, and into which the flow channels 3 lead. The end sides 47 of modules 43 through 45 are connected to a common module 48, through which all flow channels 46 can centrally have a vacuum applied thereto. In this manner, work-hold-down tables 42 of practically any size can be constructed.

It should be noted that the openings in the flow channels 3 have a width "b". Furthermore, a greatest distance "a" between two adjacent shutoff valves 2 is smaller than a least distance "A" between oppositely situated seals 7 on the underside of the modular suction device 4 (FIG. 2). This assures that, during mounting of a modular suction device 4 on a work-hold-down table 42, in each case the suction space 8 lies over a shutoff valve 2, so that in each case the space can be supplied with vacuum. A flow valve, which can for example also have a bypass, can also be used as a shutoff valve 2.

Figure 6:
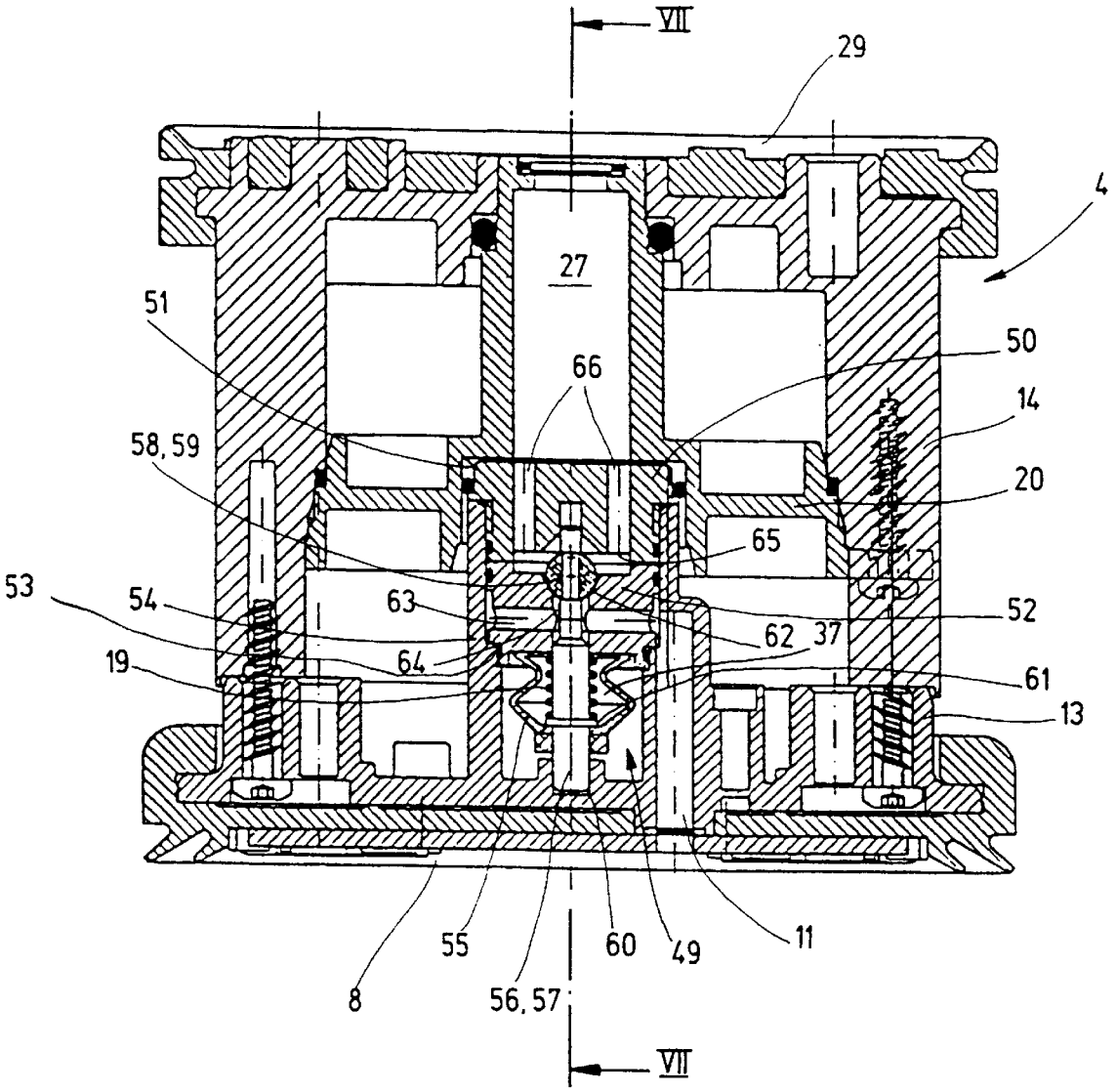
FIG. 6 is a longitudinal section taken through a second embodiment of a modular suction device of this invention.
Figure 7:
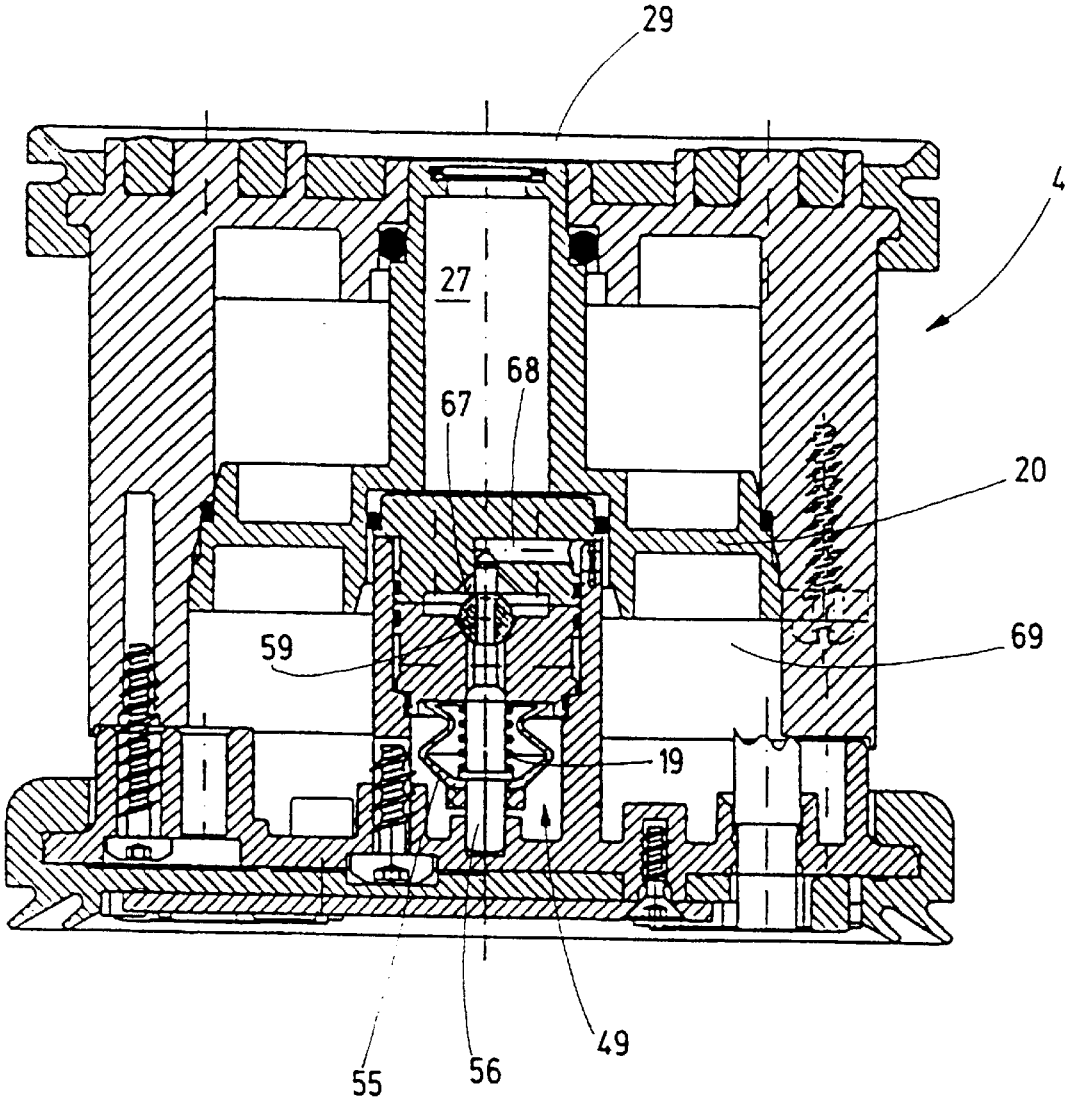
FIG. 7 is a section taken on line VII—VII in FIG. 6.

FIGS. 6 and 7 show a second embodiment of a modular suction device 4 of this invention, which likewise has a brace 20 which serves as a guide and/or mounting support for a pressure control valve 49. In this embodiment example, the pressure control valve 49 is located in the lower area of the modular suction device 4 and has an upper housing unit 50, which sits in a central recess 51 of the brace, and a lower housing unit 52, which rests on a radial shoulder 53 of a sleeve 54 which is centrally provided on the lower part 13 of the modular suction device 4 and which is open on top. By screwing the lower part 13 onto the upper part 14, both housing units 50 and 52 are fixed in place and braced against one another. An expansion bellows 55 is affixed on the underside of the housing unit 52 is, to whose lower end a slide tappet 56 is fastened. This tappet 56 serves as an actuator 57 for a valve plug 58, which is formed as a valve ball 59. A lower end of the tappet 56 is guided in a central blind hole 60, and has a surrounding collar 61 upon which a spring 19 impinges. The spring 19 itself lies on the underside of the lower housing unit 52, and presses the tappet 56 together with the expansion bellows 55 into a rest position, in which the valve ball 59 contacts a valve seat 62 on the topside of the lower housing unit 52. In this manner a flow connection is closed between a flow channel 11 and a radial hole 63, which opens radially from the lower housing unit 52 and which communicates with the flow channel 11 and into which an axial hole 64 leads. On the other side of the valve seat 62, that is, at an outlet of the axial hole 64, a distributing space 65 as well as a plurality of axial holes 66 are coupled . The axial holes open to the axial hole 27 which communicates with the hold-down space 29. The tappet 56 moves in the axial hole 64 provided in the housing unit 52, with the axial hole 64 extending to the space 37 of the expansion bellows 55.

The housing unit 50 likewise has a valve seat 67 by which a radial hole 68 can be closed fluid-tight. The radial hole 68 opens into an interior space 69 of the modular suction device 4, which communicates with the surroundings, as can be seen in FIG. 7.

If a vacuum, for example 0.3 bar, is applied to the suction space 8 of the modular suction device 4, the valve ball 59 lifts up from the valve seat 62 when air is exhausted from the expansion bellows 55 which is thereby contracted. The tappet 56 is thereby lifted against the pressure of the spring 19. The valve ball 59 assumes an intermediate position between the two valve seats 62 and 67. In this manner, air is exhausted via the axial hole 27 from the area of the hold-down space 29, and via the radial hole 68 from the interior space 69 of the modular suction device 4. This intermediate position is assumed at an applied vacuum of approximately 0.3 to 0.5 bar. If the vacuum of 0.5 is exceeded, the expansion bellows 55 is contracted such that the tappet 56 is lifted so far that the valve ball 59 contacts the upper valve seat 67, thereby closing the radial hole 68. Thus, only that amount of air is exhausted from the hold-down space 29 that allows a work piece to be clamped onto the modular suction device 4. The pressures of 0.3 and 0.5 bar are adjusted by suitable selection of the coiled pressure spring 19, that is, its length and spring characteristics. Of course, adjustments to other pressures can also be made.

If the pressure at the suction space falls below 0.5 bar, the valve ball 59 then lifts from the valve seat 67, and the axial hole 27 is ventilated through the radial hole 68. With a negative pressure of less than 0.3 bar, the valve ball 59 again contacts the valve seat 62, and ambient pressure prevails in the axial hole 27 and thus in the hold-down space 29, which ambient pressure is caused via the radial hole 68.

Figure 8:
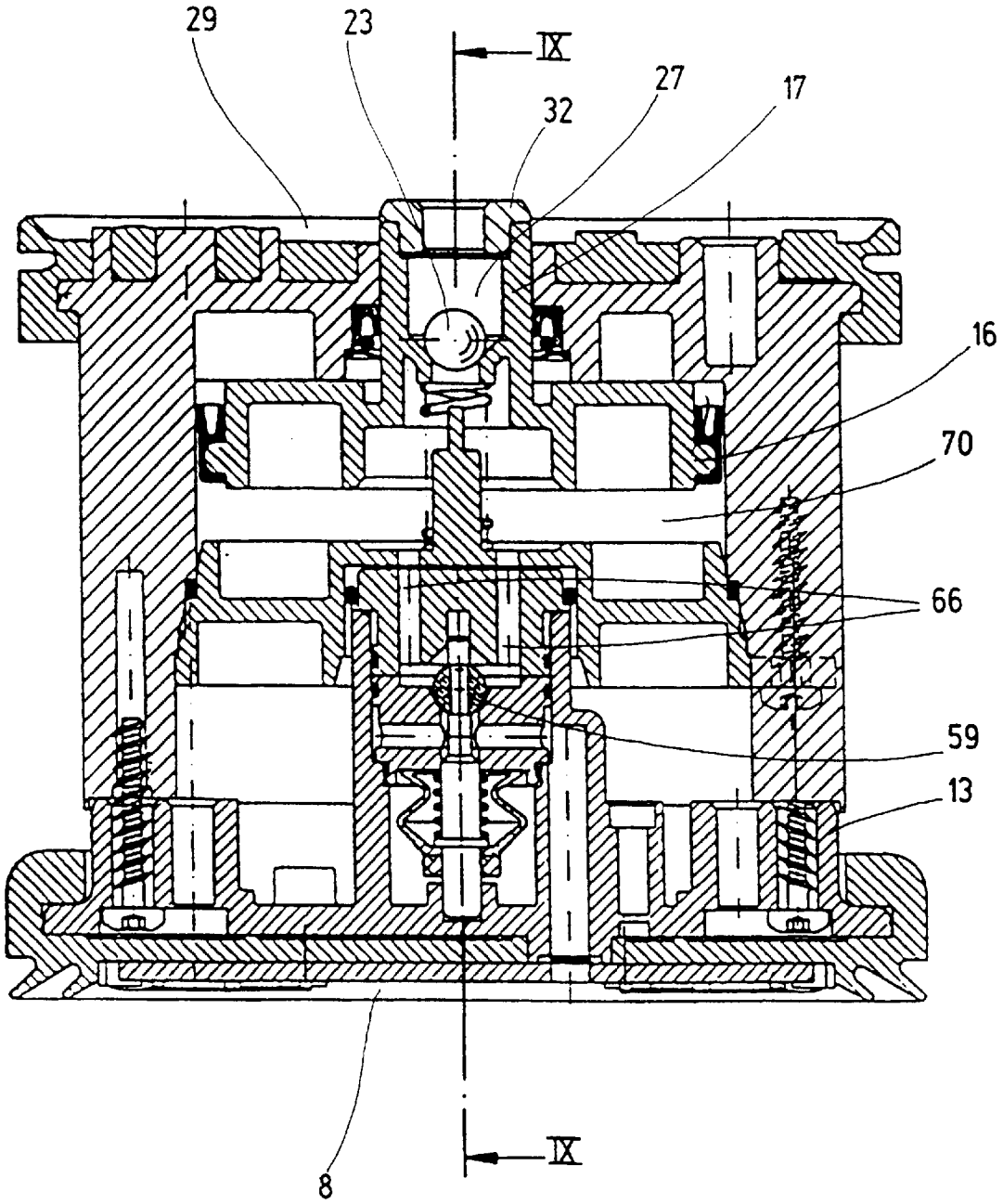
FIG. 8 is a longitudinal section taken through a third embodiment of a modular suction device of this invention.
Figure 9:
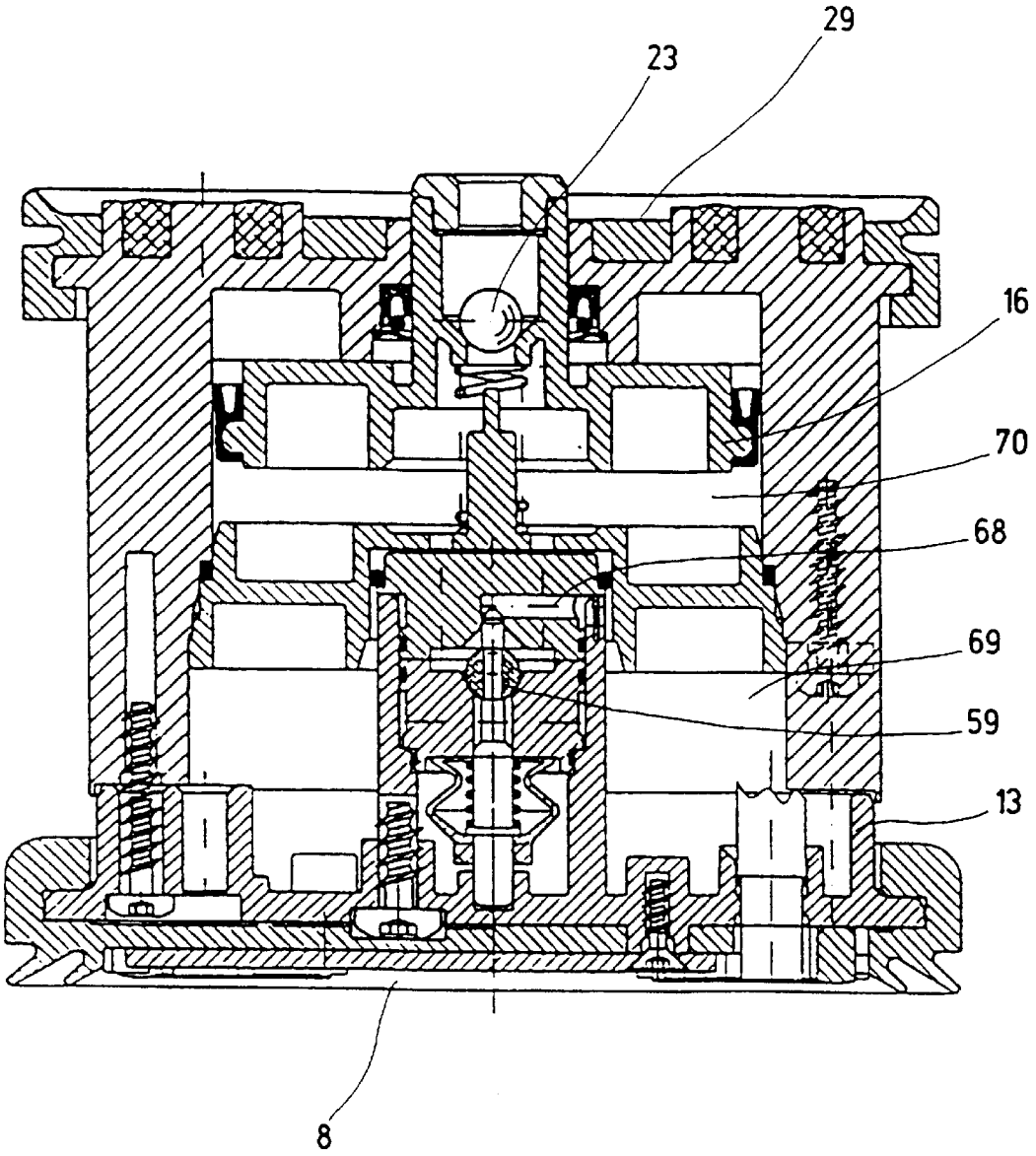
FIG. 9 is a section taken on line IX—IX in FIG. 8.

In the embodiment of FIGS. 8 and 9, axial holes 66 do not open directly to an axial hole 27, but rather, as in the embodiment of FIGS. 1 through 4, open to an intermediate space 70 through which suction is applied to a piston 16, having an extension 17. This extension 17 likewise bears a cap 32 which allows a simple sliding displacement of the work piece. The function of the piston 16 corresponds to that of the first embodiment example.

What is claimed is:

1. Vacuum hold-down system comprising a supporting base (1) and a modular suction device (4) mountable on a support surface of said supporting base (1), upon which work pieces (5) to be held down can be placed, wherein the support base (1) has shutoff valves (2) through which air suction can be applied for holding down the modular suction device (4) and/or the work piece (5), and wherein the modular suction device (4) has, on its underside (6) contacting the support surface, a seal (7) surrounding at least one shutoff valve (2), thereby forming a closed suction space (8) which can be evacuated through the shutoff valve (2), characterized in that a pressure control valve (49), which communicates with a topside (15) of the modular suction device (4), communicates with said suction space (8) and opens into a hold-down space which is surrounded by a second seal (28).

2. Vacuum hold-down system according to claim 1, characterized in that the pressure control valve (49) opens when a specified negative pressure is reached, and connects the hold-down space (29) at the topside (15) of the modular suction device (4) with the suction space (8) at the underside (6) thereof.

3. Vacuum hold-down system according claim 1, characterized in that the pressure control valve (49) can be activated by vacuum, electromagnetic signal, infrared, or the like.

4. Vacuum hold-down system according to claim 1, characterized in that the pressure control valve (49) is spring-loaded in a closed direction.

5. Vacuum hold-down system according to claim 1, characterized in that the pressure control valve (49) in its closed position projects beyond a support surface on the top side (15) of the modular suction device (4).

6. Vacuum hold-down system according to claim 1, characterized in that a distance (a) between two shutoff valves (2) or a distance (a) between flow cross sections thereof in the support plane of the supporting base (1) is less than or equal to a distance (A) between two oppositely situated seals (7) surrounding one shutoff valve (2), or is at least a distance between two oppositely situated seal edges of the seal (7) of the modular suction device (4).

7. Vacuum hold-down system according to claim 1, characterized in that the pressure control valve (49) includes a piston (16) having an axial, upwardly protruding extension (17), the extension (17) is surrounded by a seal (31), and the extension (17) has a bypass (38) that bypasses the seal (31) when the piston (16) assumes an intermediate position between closed and open positions of the pressure control valve (49).

8. Vacuum hold-down system according to claim 1, characterized in that the vacuum supply to the modular suction device is provided without use of a hose.

9. Vacuum hold-down system according to claim 1, characterized in that the pressure control valve (49) is a push valve or a flow-control valve.

10. Vacuum hold-down system according to claim 1, characterized in that the shutoff valve (2) is a valve that can be activated electromagnetically or by laser beam, and is a push valve or a flow-control valve.

11. Vacuum hold-down system according to claim 1, characterized in that the pressure control valve (49) includes a valve seat (62) and a valve plug (58), and the valve plug (58) or the valve seat (62) is coupled with an actuator (57), and the actuator (57) is connected to a contractible space (37), wherein the space (37) communicates with the suction space (8) located on the underside (6) of the modular suction device (4).

12. Vacuum hold-down system according to claim 11, characterized in that the actuator (57) is a slide tappet (56).

13. Vacuum hold-down system according to claim 11, characterized in that the contractible space (37) is enclosed by an elastic wall, in particular an expansion bellows (55).

14. Vacuum hold-down system according to claim 12, characterized in that the tappet (56) is connected to a movable section of the expansion bellows (55).

15. Vacuum hold-down system according to claim 1, characterized in that the valve plug (58) is a valve ball (23) which in one of its end positions closes a flow channel (hole 27) to the hold-down space (29), and which in its other end position closes a bypass (38).

16. Vacuum hold-down system according to claim 11, characterized in that the valve plug (58), the valve seat (62), the actuator (57), and the contractible space (37) are structured as an interchangeable unit and are arranged on a brace (20) in the modular suction device (4).

17. Vacuum hold-down system according to one of claims 11 through 15, characterized in that the actuator (57) has a spring (19) which presses it into a rest position, and in particular surrounds it.

* * * * *